US011320207B2

(12) United States Patent
Andersen

(10) Patent No.: US 11,320,207 B2
(45) Date of Patent: May 3, 2022

(54) HEAT TRANSFER PLATE FOR PLATE HEAT EXCHANGER AND PLATE HEAT EXCHANGER WITH THE SAME

(71) Applicant: Danfoss A/S, Nordborg (DK)

(72) Inventor: Benny Andersen, Nordborg (DK)

(73) Assignee: Danfoss A/S, Nordborg (DK)

( * ) Notice: Subject to any disclaimer, the term of this patent is extended or adjusted under 35 U.S.C. 154(b) by 48 days.

(21) Appl. No.: 16/196,489

(22) Filed: Nov. 20, 2018

(65) Prior Publication Data

US 2019/0154347 A1 May 23, 2019

(30) Foreign Application Priority Data

Nov. 22, 2017 (DK) ..... PA201700668

(51) Int. Cl.
*F28D 9/00* (2006.01)
*F28F 3/10* (2006.01)

(52) U.S. Cl.
CPC ..... *F28D 9/005* (2013.01); *F28F 3/10* (2013.01)

(58) Field of Classification Search
CPC ..... F28D 9/00; F28D 9/0031; F28D 9/0037; F28D 9/005; F28F 3/00; F28F 3/10; F28F 3/12
USPC ..... 165/166, 167
See application file for complete search history.

(56) References Cited

U.S. PATENT DOCUMENTS 2,191,044 A * 2/1940 Seligman ..... F28F 3/10 165/167
2,705,617 A * 4/1955 Richard ..... A23C 3/0332 165/181
4,635,714 A * 1/1987 Almqvist ..... F28F 3/10 165/167
4,905,758 A 3/1990 Mathur et al.
(Continued)

FOREIGN PATENT DOCUMENTS

CN 1672007 A 9/2005
CN 101755185 A 6/2010
(Continued)

OTHER PUBLICATIONS

Danish Search Report for Serial No. PA 2017 00668 dated Apr. 23, 2018.
(Continued)

*Primary Examiner* — Len Tran
*Assistant Examiner* — Gustavo A Hincapie Serna
(74) *Attorney, Agent, or Firm* — McCormick, Paulding & Huber PLLC

(57) ABSTRACT

A heat transfer plate (10) for a plate heat exchanger (100) includes: a plate body (11) having a first side (111) and a second side (112) opposite to the first side (111); a gasket groove (12) formed on the plate body (11), depressed from the plate body (11) in a direction from the first side (111) towards the second side (112), and having a bottom wall (120), the bottom wall (120) having a bottom wall body (121); and a recess (20, 20') formed on at least one segment (125, 125') of the bottom wall body (121) in a length direction of the bottom wall body (121), depressed from the bottom wall body (121) in the direction from the first side (111) towards the second side (112), and extending along the segment (125, 125') of the bottom wall body (121) of the gasket groove (12).

17 Claims, 9 Drawing Sheets

(56) References Cited

U.S. PATENT DOCUMENTS

| | | | | |
|---|---|---|---|---|
| 5,291,945 | A * | 3/1994 | Blomgren | B23K 1/0012 165/166 |
| 6,062,305 | A * | 5/2000 | Persson | F28F 3/083 165/167 |
| 6,513,584 | B2 * | 2/2003 | Lehmann | F28F 3/10 165/166 |
| 6,748,081 | B1 * | 6/2004 | Dultz | C09K 19/02 380/277 |
| 9,033,026 | B2 * | 5/2015 | Persson | F28F 3/046 165/70 |
| 9,212,854 | B2 * | 12/2015 | Krantz | F28F 3/10 |
| 9,746,253 | B2 * | 8/2017 | Blomgren | F28F 3/083 |
| 10,527,361 | B2 * | 1/2020 | Persson | F28F 3/08 |
| 2006/0048297 | A1 * | 3/2006 | Mills | A61G 7/1017 5/86.1 |
| 2006/0249282 | A1 * | 11/2006 | Song | F28F 3/10 165/167 |
| 2008/0196873 | A1 | 8/2008 | Svensson | |
| 2009/0159251 | A1 | 6/2009 | Blomgren | |
| 2010/0300651 | A1 * | 12/2010 | Kumar | F28D 9/005 165/70 |
| 2014/0034276 | A1 * | 2/2014 | Persson | F16J 15/062 165/167 |
| 2019/0003783 | A1 * | 1/2019 | Hedberg | F28F 3/083 |
| 2019/0277583 | A1 * | 9/2019 | Tournois | F28F 9/0226 |

FOREIGN PATENT DOCUMENTS

| | | | | |
|---|---|---|---|---|
| CN | 101918784 | A | 12/2010 | |
| CN | 103154661 | A | 6/2013 | |
| CN | 105074374 | A | 11/2015 | |
| DE | 19540271 | C1 | 11/1996 | |
| DE | 10029999 | A1 | 1/2002 | |
| EP | 1722184 | A2 | 11/2006 | |
| EP | 2626661 | A2 | 8/2013 | |
| EP | 3001131 | A1 * | 9/2014 | F28F 3/10 |
| GB | 2107845 | A | 5/1983 | |
| JP | S52130048 | A | 11/1977 | |
| RU | 2010130536 | A | 1/2012 | |
| SU | 1265456 | A1 | 10/1986 | |
| WO | 2004011868 | A1 | 2/2004 | |
| WO | 2006080874 | A1 | 8/2006 | |

OTHER PUBLICATIONS

Extended European Search Report for Serial No. EP 18 20 0292 dated Mar. 22, 2019.

* cited by examiner

HEAT TRANSFER PLATE FOR PLATE HEAT EXCHANGER AND PLATE HEAT EXCHANGER WITH THE SAME

CROSS-REFERENCE TO RELATED APPLICATION

This application claims foreign priority benefits under U.S.C. § 119 to Denmark Patent Application No. PA201700668 filed on Nov. 22, 2017, the content of which is hereby incorporated by reference in its entirety.

TECHNICAL FIELD

Embodiments of the present disclosure relates to a heat transfer plate for a plate heat exchanger and a plate heat exchanger.

BACKGROUND

FIG. 1 shows a typical construction of a plate heat exchanger 100'. The plate heat exchanger 100' comprises a plurality of heat transfer plate 10' stacked on top of each other. The heat transfer plates 10' are formed with patterns such that flow paths are formed between each set of neighbouring heat transfer plates 10'. Openings 21 and 22 are formed in the heat transfer plates 10' to form inlets and outlets for fluids to these flow paths. Gaskets 60' are positioned between the heat transfer plates 10' in gasket grooves 12' formed in the heat transfer plates. The gasket is arranged at an edge portion of the heat transfer plate to seal the flow paths and at an area around the openings to seal pairs of the openings, such that only two of them have flow access to the flow path formed at one side of the heat transfer plate, while the other two is sealed therefrom.

Especially in the opening areas the pressures are high, but the gasket is disposed at only one side of the heat transfer plate, while the other side is unsupported, thus forming a weak section.

As shown in FIG. 2, these weak sections in the areas of the high pressures may be deformed.

SUMMARY

The present disclosure provides a heat transfer plate for a plate heat exchanger and a plate heat exchanger that at least partly alleviate the deformation of the heat transfer plate at the gasket groove in use.

Embodiments of the present disclosure provide a heat transfer plate for a plate heat exchanger. The heat transfer plate comprises: a plate body having a first side and a second side opposite to the first side; a gasket groove formed on the plate body, depressed from the plate body in a direction from the first side towards the second side, and having a bottom wall, the bottom wall having a bottom wall body; and a recess formed on at least one segment, in the following defined as a length wise direction of the gasket groove, of the bottom wall body in a length direction of the bottom wall body, depressed from the bottom wall body in the direction from the first side towards the second side, and extending along the segment of the bottom wall body of the gasket groove.

According to embodiments of the present disclosure, the recess comprises two recesses respectively disposed on two sides of the at least one segment in a width direction of the at least one segment, and spaced from each other in the width direction of the at least one segment.

According to embodiments of the present disclosure, the recess is disposed on a middle portion of the at least one segment in a width direction of the at least one segment of the bottom wall body.

According to embodiments of the present disclosure, the recess comprises a first recess and a second recess, the at least one segment comprises a first segment and a second segment, the first recess and the second recess are formed on the first segment and the second segment, respectively, and the first recess is deeper than the second recess.

According to embodiments of the present disclosure, the heat transfer plate further comprises: an inlet opening formed in the plate body for forming an inlet port of the plate heat exchanger; and an outlet opening formed in the plate body for forming an outlet port of the plate heat exchanger. The first segment is in an area around the inlet opening and the outlet opening, and the second segment extends in a direction from the inlet opening to the outlet openings along an edge portion of the plate body.

According to embodiments of the present disclosure, the first segment comprises a circular portion and a connection portion connecting the circular portion to the second segment.

According to embodiments of the present disclosure, the bottom wall body comprises the at least one segment, and the other segment that is essentially flat.

Embodiments of the present disclosure also provide a plate heat exchanger. The plate heat exchanger comprises: the heat transfer plates which are stacked on top of each other; and gaskets disposed in the gasket grooves of some of the plurality of heat transfer plates.

According to embodiments of the present disclosure, each of gaskets has a gasket body with a top surface, and a protrusion protruding from a middle portion, in a width direction of the top surface, of the top surface, and extending along a length direction of the gasket body.

According to embodiments of the present disclosure, the recess comprises two recesses respectively disposed on two sides of the at least one segment in a width direction of the at least one segment, and spaced from each other in the width direction of the at least one segment by a predetermined distance, and a top of the protrusion of each of gaskets has a width less than the predetermine distance.

According to embodiments of the present disclosure, the recess is disposed on a middle portion of the at least one segment in a width direction of the at least one segment of the bottom wall body, and a top of the protrusion of each of gaskets has a less width than the recess.

These and other objects, features and advantages of the present disclosure will become apparent in light of the detailed description of embodiments thereof, as illustrated in the accompanying drawings.

DETAILED DESCRIPTION

Figure 3:
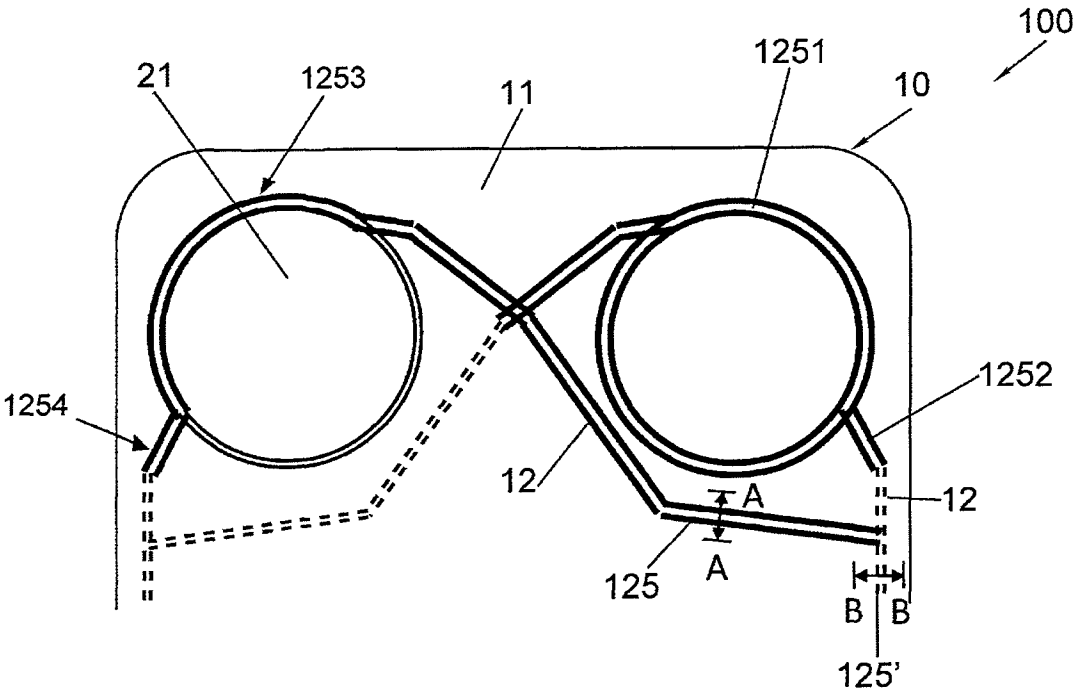
FIG. 3 is a schematic view of a part of a plate heat exchanger according to embodiments of the present disclosure.

Referring to FIG. 3, a plate heat exchanger 100 according to embodiments of the present disclosure is shown. Referring to FIGS. 2 to 9B, the plate heat exchanger 100 comprises: a plurality of heat transfer plates 10 which are stacked on top of each other; and gaskets 60 disposed in gasket grooves 12 of some of the plurality of heat transfer plates 10.

Figure 4:
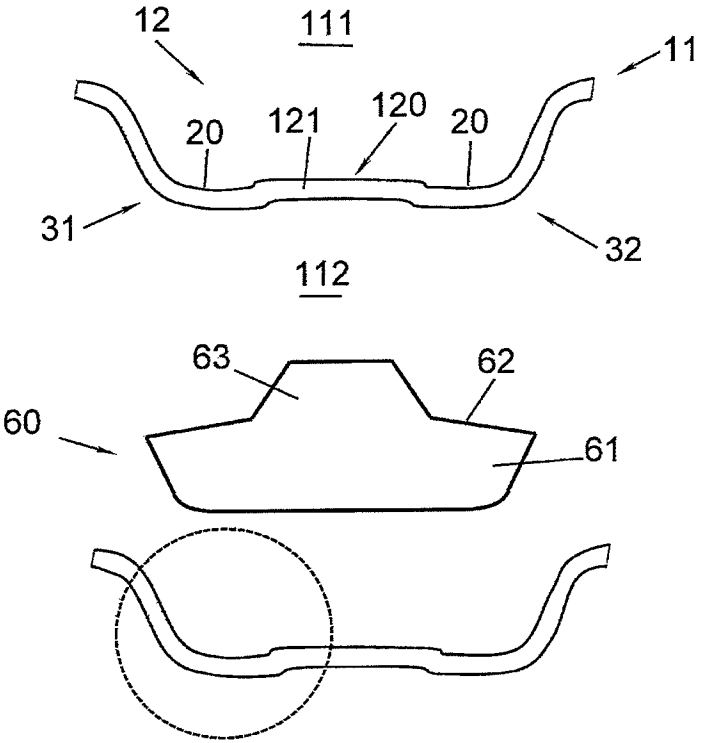
FIG. 4 is a schematic sectional view, taken along the line AA in FIG. 3, of a gasket groove and a gasket of the plate heat exchanger according to an embodiment of the present disclosure.
Figure 5:
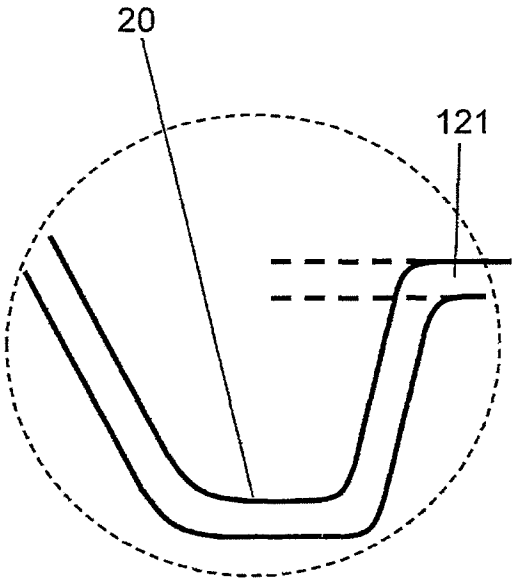
FIG. 5 is a schematic partially enlarged sectional view of the gasket groove of FIG. 4.
Figure 6:
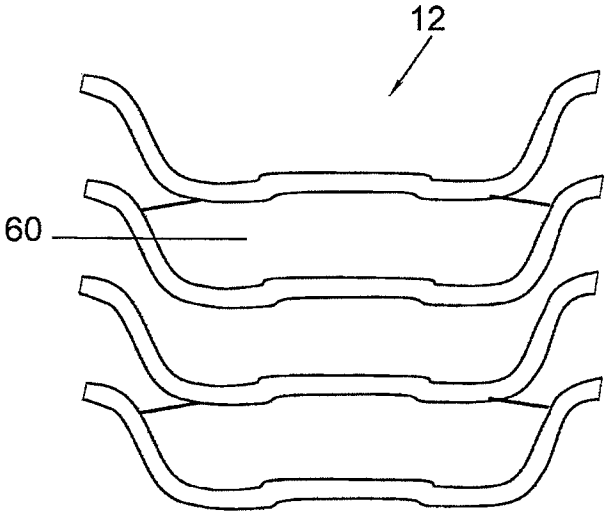
FIG. 6 is a schematic sectional view showing the gasket grooves of stacked heat transfer plates of the plate heat exchanger of FIG. 3 and the gaskets among them.
Figure 7:
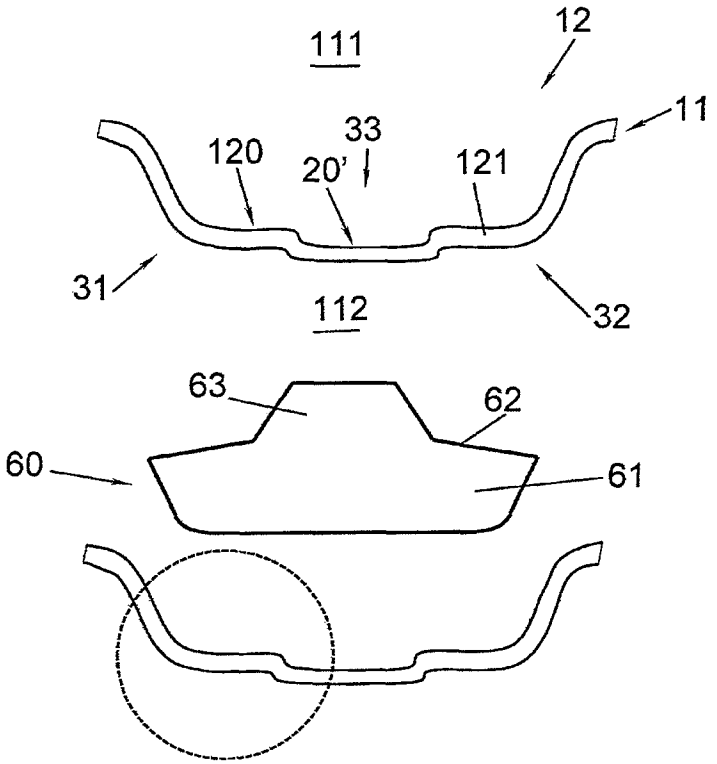
FIG. 7 is a schematic sectional view, taken along the line AA in FIG. 3, of a gasket groove and a gasket of the plate heat exchanger according to another embodiment of the present disclosure.

Referring to FIGS. 4 and 7, each of gaskets 60 may have a gasket body 61 with a top surface 62, and a protrusion 63. The protrusion 63 protrudes from a middle portion, in a width direction of the top surface 62, of the top surface 62, and extends along a length direction of the gasket body 61. The protrusion 63 may have a tapered section.

In an embodiment, referring to FIGS. 3 to 6, the heat transfer plate 10 comprises a plate body 11 having a first side 111 and a second side 112 opposite to the first side 111. The heat transfer plate 10 further comprises a gasket groove 12. The gasket groove 12 is formed on the plate body 11, is depressed from the plate body 11 in a direction from the first side 111 towards the second side 112 and has a bottom wall 120 with a bottom wall body 121. The heat transfer plate 10 further comprises a recess 20. The recess 20 is formed on at least one first segment 125 (FIG. 3) of the bottom wall body 121 in a length direction of the bottom wall body 121, is depressed from the bottom wall body 121 in the direction from the first side 111 towards the second side 112 and extends along the first segment 125 of the bottom wall body 121 of the gasket groove 12.

In FIG. 3, the first segment 125 of the bottom wall body 121 where the recess 20 is formed is indicated by solid lines, while the other segment of the bottom wall body 121 where no recess 20 is formed is denoted by dashed lines. The other segment of the bottom wall body 121 may be essentially flat.

Referring to FIG. 4, the recess 20 may comprise two recesses 20. The two recesses 20 are respectively disposed on two sides 31, 32 of the at least one first segment 125 in a width direction of the at least one first segment 125 and are spaced from each other in the width direction of the at least one first segment 125 by a predetermined distance. For example, a top of the protrusion 63 of each of gaskets 60 may have a width less than the predetermine distance so that the top of the protrusion 63 is fitted in a depression 30 formed on the bottom wall 120 by the two recesses 20.

In one embodiment relating to any of the indicated embodiments in the figures, the gasket at its lower surface 64 is has a shape that does not reflect the recess(es) 20, 20'. In one embodiment the lower surface is essentially flat. When squeezed between two heat transfer plates 10 the lower surface 64 is deformed into the recess(es) 20, 20'.

Figure 8:
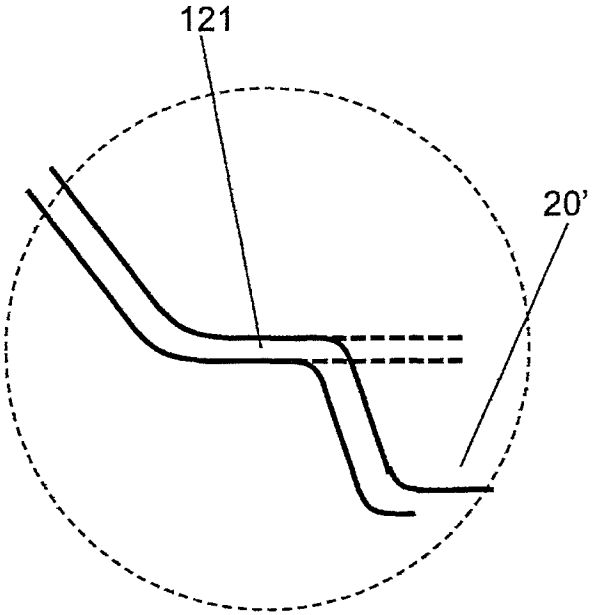
FIG. 8 is a schematic partially enlarged sectional view of the gasket groove of FIG. 7.
Figure 9B:
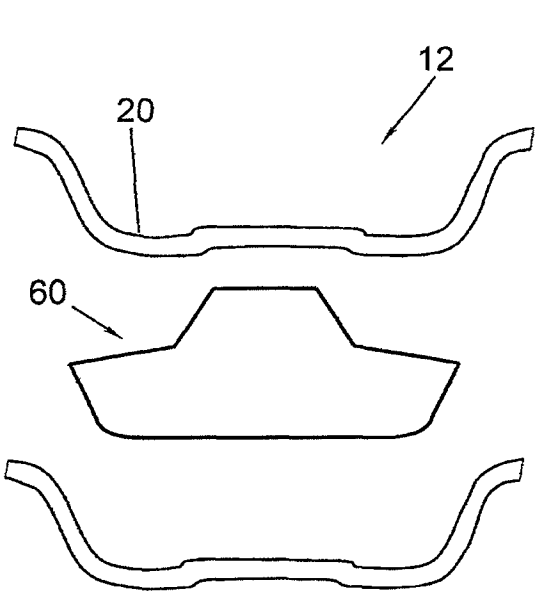
FIG. 9B is a schematic sectional view, taken along the line BB in FIG. 3, of a gasket groove and a gasket of the plate heat exchanger according to the still another embodiment of the present disclosure.
Figure 9A:
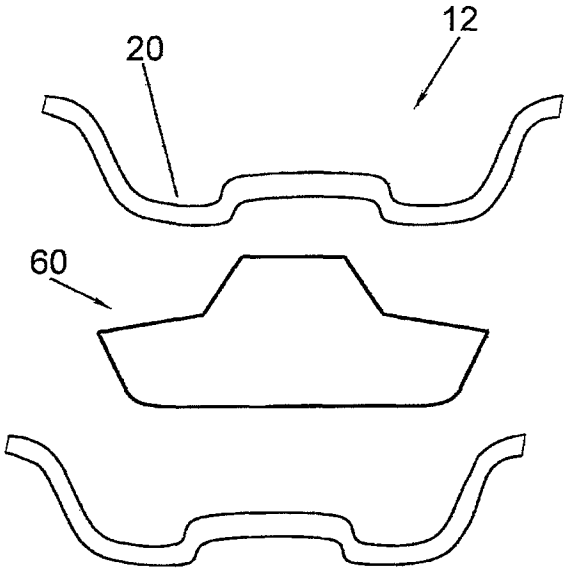
FIG. 9A is a schematic sectional view, taken along the line AA in FIG. 3, of a gasket groove and a gasket of the plate heat exchanger according to still another embodiment of the present disclosure.

In another embodiment, referring to FIGS. 7 to 8, instead of the two recesses 20 shown in FIG. 4, the recess 20' is disposed on a middle portion 33 of the at least one segment 125 in a width direction of the at least one segment 125 of the bottom wall body 121. For example, a top of the protrusion 63 of each of gaskets 60 may have a less width than the recess 20'.

In the embodiments a second segment 125' of the bottom wall body 121 if the bottom wall 120 is different from that the first second segment 125. In one embodiment the second r segment 125' bottom wall body 121 of the bottom wall 120 is essentially flat. In other more general embodiments, a section of the bottom wall body 121 of the bottom wall 120 where no recess is formed may be essentially flat.

In a further embodiment, referring to FIGS. 3, 4, 9A and 9B, the recess 20 comprises a first recess 20 and a second recess 20, the at least one segment 125, 125' comprises a first segment 125 as indicated by the solid lines shown in FIG. 3 and a second segment 125' as indicated by the dashed lines shown in FIG. 3, the first recess 20 and the second recess 20 are formed on the first segment 125 and the second segment 125', respectively, and the first recess 20 is deeper than the second recess 20. Alternatively, referring to FIGS. 3, 7, 9A and 9B, the recess 20' comprises a first recess 20' and a second recess 20', the at least one segment 125, 125' comprises a first segment 125 as indicated by the solid lines shown in FIG. 3 and a second segment 125' as indicated by the dashed lines shown in FIG. 3, the first recess 20' and the second recess 20' are formed on the first segment 125 and the second segment 125', respectively, and the first recess 20' is deeper than the second recess 20'.

Figure 1:
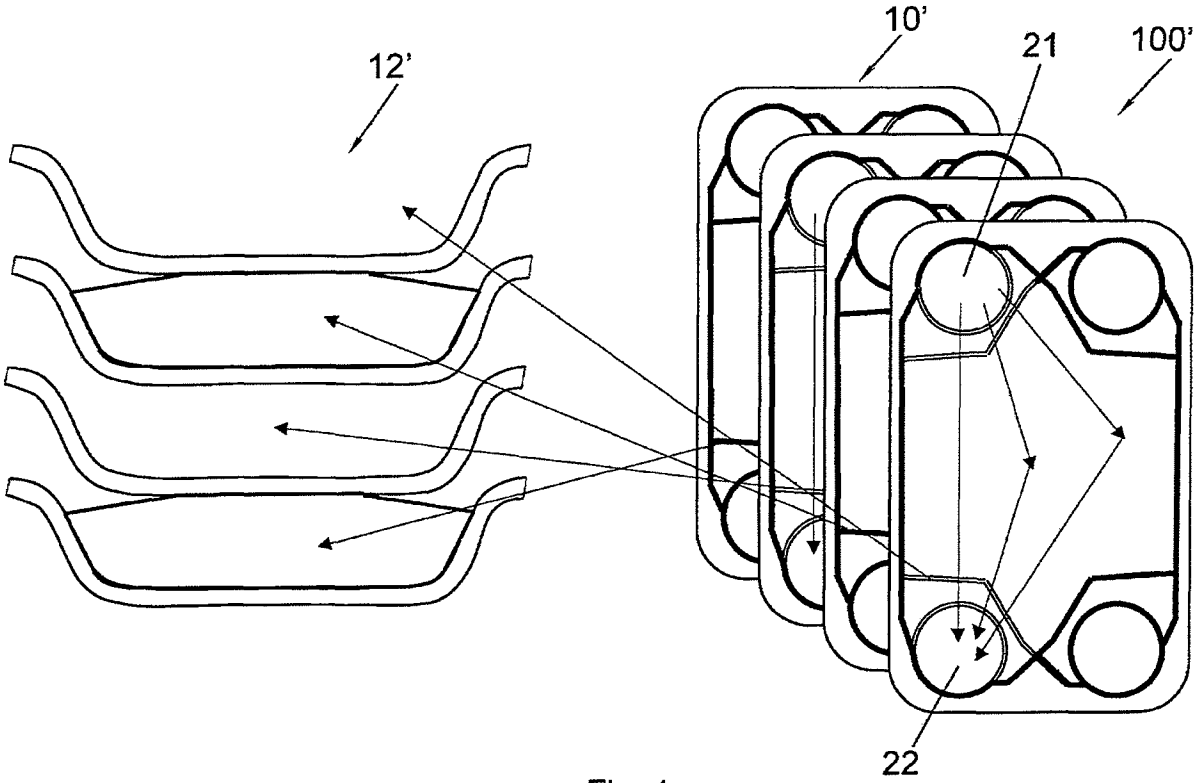
FIG. 1 is a schematic view of a prior art plate heat exchanger.
Figure 2:
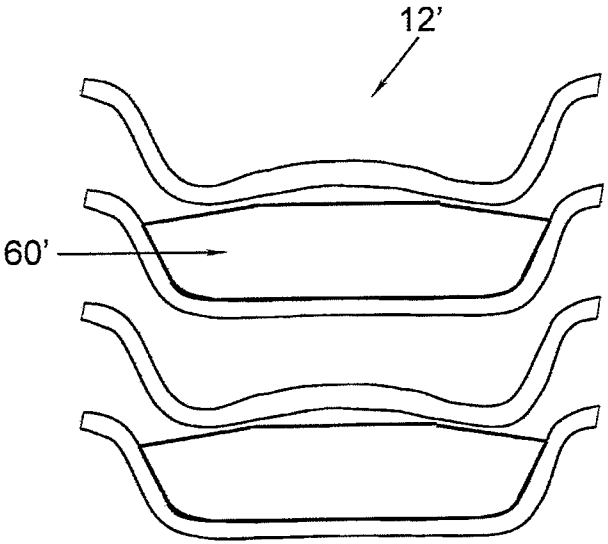
FIG. 2 is a schematic view of a gasket groove and a gasket of the prior art plate heat exchanger of FIG. 1.

Referring to FIGS. 1, and 3, the heat transfer plate 10 further comprises: an inlet opening 21 formed in the plate body 11 for forming an inlet port of the plate heat exchanger 100; and an outlet opening 22 formed in the plate body 11 for forming an outlet port of the plate heat exchanger 100. In an embodiment relevant to any of the previous embodiments, the first segment 125 is in an area around the inlet opening 21 and the outlet opening 22, and the second segment 125' extends in a direction from the inlet opening 21 to the outlet openings 22 along an edge portion of the plate body 11. For example, the second segment 125' extends in a length direction of the heat transfer plate 10. The first segment 125 may comprise a sealing 1251 and a first connection portion 1252 connecting the sealing portion 1251 to the second segment 125'. The sealing portion 1251 is positioned to seal an opening from the flow path formed at the respective side of the heat transfer plate 10, and thus may be formed at the circumference of said opening, and possible being circular. The segment 125 of the bottom wall body 121 where the recess 12 is formed may be set according to a specific structure and an operational pressure of a plate heat exchanger and is not limited to the described embodiments.

In an embodiment relevant to any of the previous embodiments, the first segment 125 further comprises a semi-sealing portion 1253 positioned in relation to an active opening inlet or outlet relative to the flow path formed at the respective side of the heat transfer plate 10, and thus may be formed at a part of the circumference of said opening, and possible being semi-circular. A second connection portion 1254 may connect the semi-sealing portion 1253 to the second segment 125'.

The first 1252 and/or second 1254 connection portions may be straight, curved, bend, meandering, and may reach into the part of the bottom wall 120 with a bottom wall body 121 extending at the long edge of the heat transfer plate 10 from an inlet to an outlet.

With the heat transfer plate 10 and the plate heat exchanger 100 according to the embodiments of the present disclosure, the portion of the heat transfer plate 10 where the gasket groove 12 is formed is reinforced by forming the recess 20 and 20', thereby alleviating deformation of the portion of the heat transfer plate 10 and thus avoid possible fluid leakage.

While the principles of the present disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A plate heat exchanger comprising a plurality of heat transfer plates stacked on top of each other, each heat transfer plate of the plurality of heat transfer plates comprising:

a plate body having a first side and a second side opposite to the first side;

a gasket groove formed on the plate body, depressed from the plate body in a direction from the first side towards the second side, the gasket groove having two side walls and a bottom wall, each side wall extending downward from the plate body to the bottom wall, the bottom wall having a bottom wall body;

wherein the gasket groove includes a first segment and a second segment serially arranged and connected in a lengthwise direction of the gasket groove, the first segment extending along a first length of the gasket groove, and the second segment extending along a second length of the gasket groove that is different than the first length, the first segment being in an area around an inlet opening, and the second segment extending in a direction from the inlet opening to an outlet opening along an edge portion of the plate body;

wherein a first recess is formed on the bottom wall body in the first segment of the gasket groove, the first recess extending along the first segment of the gasket groove in a length direction of the first segment of the gasket groove and being depressed in the bottom wall body in the direction from the first side towards the second side;

wherein the bottom wall body in the second segment of the gasket groove is shaped differently from the bottom wall body of the first segment, thereby providing the gasket groove with a different cross-section in the second segment than the first segment; and wherein gaskets are disposed in respective gasket grooves, the gaskets being disposed in the first segments of the gasket grooves on only one side of each heat transfer plate of the plurality of heat transfer plates, and wherein a second recess is formed on the second segment, and the first recess is deeper than the second recess.

2. The plate heat exchanger of claim 1, wherein:

the recess comprises two first recesses respectively disposed on two sides of the first segment in a width direction of the first segment, and spaced from each other in the width direction of the first segment.

3. The plate heat exchanger of claim 1, wherein:

the first recess is disposed on a middle portion of the first segment in a width direction of the first segment of the bottom wall body.

4. The plate heat exchanger of claim 1, further comprising:

the inlet opening formed in the plate body for forming an inlet port of the plate heat exchanger; and the outlet opening formed in the plate body for forming an outlet port of the plate heat exchanger, wherein:

the first segment is in an area around the inlet opening and the outlet opening, and the second segment extends in a direction from the inlet opening to the outlet opening along the edge portion of the plate body.

5. The plate heat exchanger of claim 4, wherein:

the first segment comprises a circular portion and a connection portion connecting the circular portion to the second segment.

6. The plate heat exchanger according to claim 1, wherein:

each of the gaskets has a gasket body with a top surface, and a protrusion protruding from a middle portion in a width direction of the top surface, and extending along a length direction of the gasket body.

7. The plate heat exchanger according to claim 6, wherein:

the recess comprises two first recesses respectively disposed on two sides of the first segment in a width direction of the first segment, and spaced from each other in the width direction of the first segment by a predetermined distance, and a top of the protrusion of each of the gaskets has a width that is shorter than the predetermine distance.

8. The plate heat exchanger according to claim 6, wherein:

the first recess is disposed on a middle portion of the first segment in a width direction of the first segment of the bottom wall body, and a top of the protrusion of each of the gaskets has a width that is shorter than the recess.

9. The plate heat exchanger according to claim 1, wherein each gasket has a lower surface with a shape that does not reflect the recess.

10. The plate heat exchanger according to claim 6, wherein each gasket has a lower surface with a shape that does not reflect the recess.

11. The plate heat exchanger according to claim 7, wherein each gasket has a lower surface with a shape that does not reflect the recess.

12. The plate heat exchanger according to claim 8, wherein each gasket has a lower surface with a shape that does not reflect the recess.

13. The plate heat exchanger of claim 1, wherein the bottom wall body of the bottom wall of the second segment is flat.

14. A plate heat exchanger comprising a plurality of heat transfer plates stacked on top of each other, each heat transfer plate comprising:

a plate body having a first side and a second side opposite to the first side;

a gasket groove formed on the plate body, depressed from the plate body in a direction from the first side towards the second side, the gasket groove having two side walls and a bottom wall, each side wall extending downward from the plate body to the bottom wall and the bottom wall having a bottom wall body;

wherein the gasket groove includes a first segment and a second segment serially arranged and connected in a lengthwise direction of the gasket groove, the first segment extending along a first length of the gasket groove, and the second segment extending along a second length of the gasket groove that is different than the first length, the first segment being in an area around an inlet opening, and the second segment extending in a direction from the inlet opening to an outlet opening along an edge portion of the plate body;

wherein the first segment of the gasket groove includes a recess extending the length of the first segment, the recess being formed on the bottom wall body in a length direction of the first segment of the gasket groove, the recess being depressed in the bottom wall body in the direction from the first side towards the second side;

wherein the bottom wall body of the bottom wall of the gasket groove in the second segment is shaped differently from the bottom wall body of the first segment, thereby providing the gasket groove with a different cross-section in the second segment than the first segment; and wherein gaskets are disposed in respective gasket grooves, the gaskets being disposed in the first segments of the gasket grooves on only one side of each heat transfer plate of the plurality of heat transfer plates, and wherein a second recess is formed on the second segment, and the first recess is deeper than the second recess.

15. The plate heat exchanger of claim 14, wherein the bottom wall body of the bottom wall of the second segment is flat.

16. The plate heat exchanger of claim 14, wherein:

the recess comprises two recesses respectively disposed on two sides of the first segment in a width direction of the first segment, and spaced from each other in the width direction of the first segment.

17. The plate heat exchanger of claim 14, wherein:

the recess is disposed on a middle portion of the bottom wall body of the first segment in a width direction of the first segment.

* * * * *